United States Patent [19]

Dain

[11] 4,191,516

[45] Mar. 4, 1980

[54] ATOMIZER FOR MAKING POWDER

[75] Inventor: Richard J. Dain, Crouch, England

[73] Assignee: Powdrex Limited, London, England

[21] Appl. No.: 863,645

[22] Filed: Dec. 23, 1977

[30] Foreign Application Priority Data

Dec. 23, 1976 [GB] United Kingdom ..... 53878/76

[51] Int. Cl.[2] ..... B22D 23/08

[52] U.S. Cl. ..... 425/7; 264/11

[58] Field of Search ..... 425/7; 264/11

[56] References Cited

U.S. PATENT DOCUMENTS

| | | | |
|---|---|---|---|
| 2,956,304 | 10/1960 | Batten et al. | 425/7 |
| 3,551,532 | 12/1970 | Laird | 425/7 |
| 3,588,951 | 6/1971 | Hegmann | 425/7 |
| 3,814,588 | 6/1974 | Ayers | 425/7 |

*Primary Examiner*—Robert F. White
*Assistant Examiner*—James R. Hall
*Attorney, Agent, or Firm*—Blum, Kaplan, Friedman, Silberman & Beran

[57] ABSTRACT

An atomizer for making powder of the type in which an atomizing chamber above a water bath container defines a path for a falling stream of molten metal and nozzles supply downwardly directed opposed ribbon sectioned jets of water at an angle to the vertical to impinge on the metal stream and atomize it. The atomized particles are then quenched by further water. According to this invention there are two pairs of opposed nozzles on lines mutually at right angles arranged so that the jets from the first pair intersect at a level above the level of intersection of the second pair. The jets from the first pair form the metal stream into a ribbon section in a plane containing the second pair of nozzles and the jets from the second pair atomize the stream.

According to another feature the energy of the water flow of these jets is used to induce a circulating secondary flow of quench water in the atomizing zone thus eliminating the need for a purged supply of quench water.

13 Claims, 2 Drawing Figures

ATOMIZER FOR MAKING POWDER

BACKGROUND OF THE INVENTION

This invention relates to the production of metal powder, i.e. metal in powder or particulate form. Metal powder, which is used in powder metallurgical processes can be produced by shattering or "atomizing" molten metal by gas or liquid jets and rapidly quenching the resulting metal droplets.

Conventional powder water atomizers consist of a melting furnace, a tundish, optionally a ladle for transferring molten steel from the melting furnace to the tundish, the tundish containing a tundish pouring nozzle, an atomizing chamber containing nozzle means for directing opposed high pressure jets of water at the liquid stream of metal falling from the tundish nozzle to atomize it into discrete particles, a secondary chamber or second region of the atomizing chamber in which lower pressure water is pumped to quench the atomized particles, and a collection tank which is continuously emptied by a slurry pump during the atomization run. The resultant powder is of moderate yield, of high to moderate oxygen content and of moderate irregularity, the degrees of quality for a given atomizer depending amongst other factors upon the alloy being melted.

SUMMARY OF THE INVENTION

An object of the present invention is to provide an improved atomizer giving high yields of usable powder which is of good compactability and of low oxygen content.

A still further object is to provide an atomizer which needs no pumped supply of quench water, thus allowing a smaller and safer atomizer.

In one aspect the present invention provides an atomizer for making powder comprising an atomizing chamber above a water bath the vessel having a lower part which widens out to be of inverted dished shape and a lower edge which extends into the water bath and defining a path for a falling stream of molten metal through the chamber towards the water bath, nozzle means arranged to supply two pairs of downwardly directed, substantially narrow rectangular sectioned primary jets of water, each at an angle to the vertical, the jets of each pair being symmetrically on opposite sides of the path of the metal stream, the nozzles of the pairs being on lines mutually at right angles, and a first of the pairs of jets intersecting at a level above the level of intersection of the second of the pairs such that in use the first of the pairs impinges on the metal stream to form it into a ribbon shape substantially in a plane containing the second pair of nozzles and the second pair of jets impinges on the ribbon to complete atomizing into discrete particles of molten metal the jets then impinging on the water bath and inducing a secondary circulation of quench water in the water bath, up the walls of the said lower part and within said lower part of the atomizing chamber, the volume of the secondary circulation being greater than the volume of the primary jet flow and acting to quench the particles into powder.

In a further aspect the invention provides an atomizer for making powder comprising an atomizing chamber above a water bath, means for establishing a falling stream of molten metal through the chamber towards the water bath, nozzle means arranged to supply downwardly directed primary jets of water under pressure at an angle to the vertical to impinge on the stream and cause atomization of the metal into discrete particles, the water bath and atomizing chamber being shaped and arranged relative to one another such that the energy of the jet water induces a secondary circulation of quench water in the water bath in and under the atomizing chamber of a greater volume than the primary jet flow so as to quench the atomized particles without other means for pumping secondary quench water.

I have found that by correct choice of refractory materials to suit the particular alloy being produced in the melting furnace, the tundish and the tundish nozzle, I achieve a very low inclusion content in the product made from the final powder. For example for high speed steel I use a magnesite refractory for the melting furnace, a high alumina based refractory for the tundish and a zirconia or sillimanite material for the nozzle.

It is important that the atomizing water should be supplied in the form of 4 substantially rectangular sectioned flow pattern jets, which are preferably supplied with water in the pressure range 500–3000 psi. The quantity of atomizing water supplied depends on the size of the tundish nozzle and the flow and shape characteristics of the required powder, but with advantage the weight flow is in the range 0.2 to 16 times the flow per minute of metal, i.e. metal flow through the tundish nozzle.

The jets are arranged in pairs, jet outlets substantially but not necessarily on the same horizontal plane, the members of each pair diametrally opposed on a circle with the metal stream at or near centre and the diameters joining the members of each pair mutually at right angles.

The jets of each pair, being inclined at a narrow angle to the vertical, intersect at or near the axis of the tundish nozzle, one pair being at a narrower angle to the vertical than the other, and therefore intersecting at a point below the other pair.

If the angle of the upper pair is too wide to the vertical we find that the water can splash back up and against the underside of the tundish nozzle. If the angle is too narrow to the vertical it impinges with the metal stream too far below the tundish nozzle, and therefore is subject to wandering of the metal stream and loss of atomizing effect. In addition the metal stream can oxidise and cool quickly, and for that reason the height of free fall preferably does not exceed 12 inches.

Accordingly I have chosen angles for the top jets between 16° and 35° to the vertical, preferably 26°–27°, and for the bottom jets between 10° and 20° to the vertical, preferably 15½°–16½° and in particular 26½° for the top jets and 16° for the lower.

The flows in all jets would normally be equal, but can be varied to optimise powder quality so that the total flow in the lower jets can be as low as 50% of that in the upper and as high as 200%.

With this arrangement the upper jets form the metal stream into a ribbon of partially atomized material along the same diameter as the diameter joining the lower jets. The lower jets then impinge on that ribbon and complete atomization of the metal into discrete irregular particles of molten or partially molten metal.

In conventional atomizers a second low pressure high flowrate water stream is directed at the now atomized metal particles to quench cool them to the solid condition. Of necessity this means that the atomizer is mounted on the top of a relatively large vessel, and the quantities of water involved to quench the metal effectively are such as to require a large pump capable of recirculating a mixture of powder and water.

The quench water level used in my atomizer lies close to or at the point of intersection of the bottom jets. By combining the design of these primary atomizing jets and that of the atomizing chamber it has been found possible to use the residual energy of the primary jets to induce very high circulating secondary quench water flows, of the order of 15 to 40 times the primary water flow.

By this means I achieve an exceptionally fast rate of quench which reduces oxidation of the metal powder particles and improves irregularity and therefore powder compactability. In addition it dispenses with the need for secondary water circulating pumps, eliminating the mechanical disadvantages of high impeller wear rates and the safety aspect of relying upon a pump to prevent the level of quench water rising to the level of the tundish nozzle.

In order to encourage the circulation of water the atomizing nozzle block is placed in the flanged neck of a dished ended vessel. The sides of the vessel lie 2 to 6" below quench water level so isolating the atomizing chamber from atmosphere. The profiles of the vessel dished end and sides are such as to direct the circulating water inwards to the atomizing zone.

DETAILED DESCRIPTION OF A PREFERRED EMBODIMENT

Figure 1:
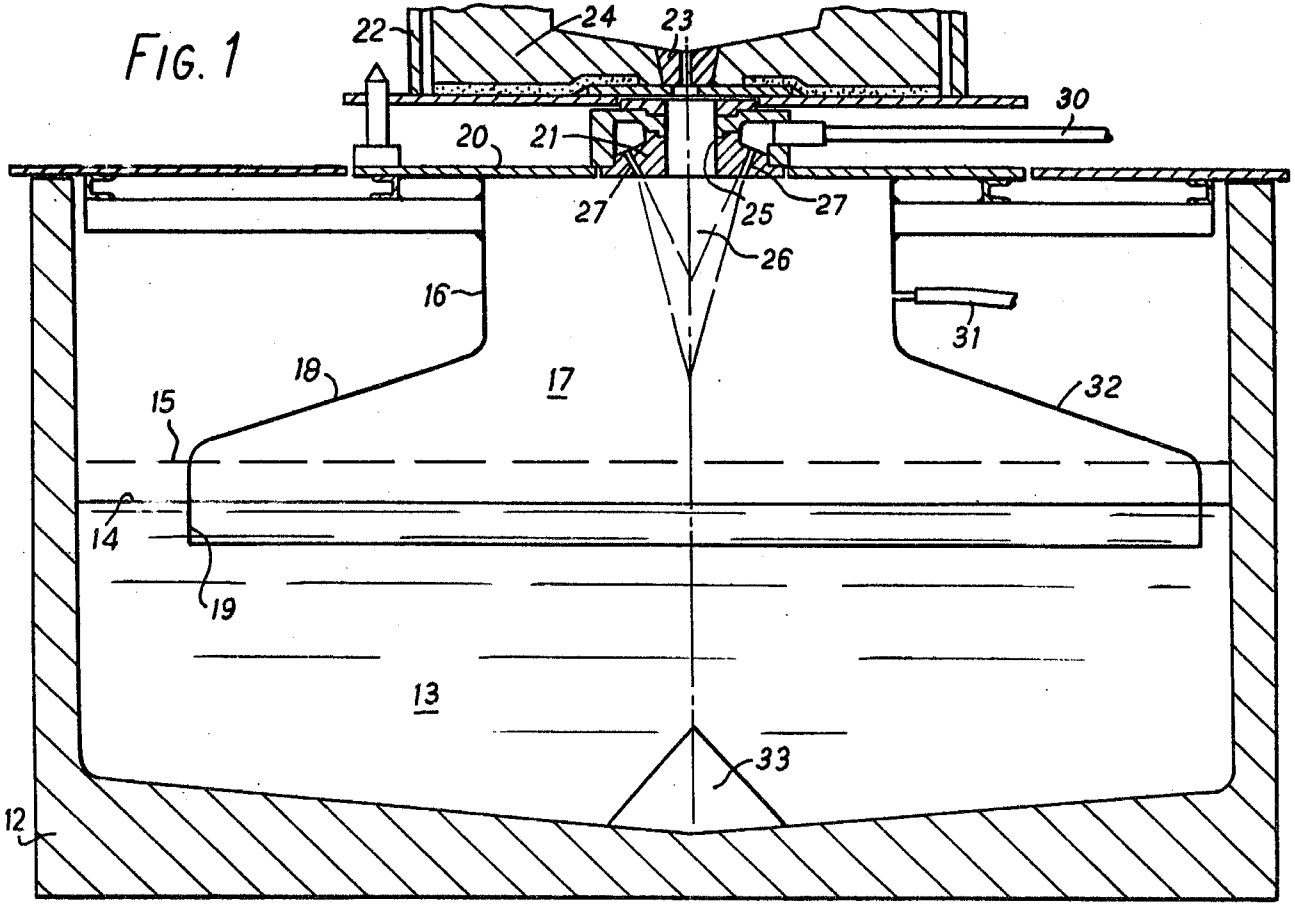
FIG. 1 is a diagrammatic axial sectional view through an atomizer.

Referring first to FIG. 1, a water bath container 12 has water 13 therein, the normal starting level 14 of which is about half way up the container and the maximum working level 15 of which is 2" above the starting level 14. Supported in the upper half of the container is a vessel 16 defining an atomizing chamber 17 above the water bath. The vessel 16 has a tubular upper portion and a lower end 18 which widens out to be of inverted dished form, the lower edge 19 having a diameter greater than twice the diameter of the tubular portion and being immersed 2 to 6" below the normal starting level of the water. As seen in FIG. 1, the sloping wall 32 of the lower part makes a greater angle with the vertical than with the horizontal, in this case the wall is at an angle of 20° to the horizontal. The upper end of vessel 16 is sealed by a flange 20 and supports coaxially with the vessel 16 a nozzle block 21. A tundish, the lower portion of which is shown at 22 is supported above the nozzle block and has a tundish nozzle at 23 coaxial with the nozzle block and atomizing chamber. When molten metal 24 is poured into the tundish a stream of the molten metal passes through the nozzle 23 falls through the atomizing chamber and towards the water bath along the axis 26.

Figure 2:
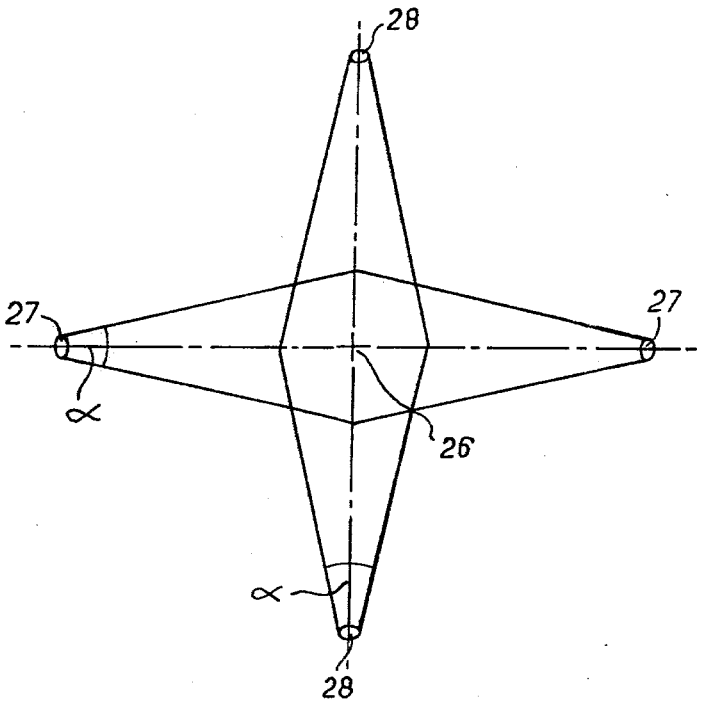
FIG. 2 is a plan view showing the water jet configuration.

The nozzle block 21 has two pairs of nozzles, one pair being seen at 27 in FIGS. 1 and 2 and the other pair 28 being seen only in FIG. 2. These nozzles lie on a pitch circle of diameter 3.90±0.02" with the axis 26 at the centre thereof. The line joining nozzles 27 is normal to the line joining nozzles 28. The nozzle block is connected to a pipe 30 for the supply of high pressure water. Each of the nozzles is arranged to supply a jet of water of narrow rectangular sectioned form having a narrow dimension in the range 1–5 mm and a major dimension 2–8 mm, widening out at angles $\alpha$ which need not be the same for each pair, whicn in nozzle tests at water pressures of 40 psi are shown to be in the range 10°–40° and typically 25° so that at the line of intersection of the top jets the width of the jets in these nozzle tests is in the range 0.5 to 3.0" and typically 1.65". The upper jets from the nozzles 27 make an angle of 26½° with the vertical so that they intersect on a line containing the axis 26 at a level less than 12" below the bottom of the tundish nozzle 23. They act to form the falling stream of molten metal into a ribbon in a plane containing the axis 26 and the nozzles 28. The jets from the nozzles 28 make an angle of 16° with the vertical and thus intersect at a level in the range 2–6" below the level of intersection of the jets from nozzles 27 and at a level in the range 0–24" and preferably 6" above the bath water level 14. These jets act to shatter the ribbon of molten metal into discrete particles which are immediately quenched. These jets are shown, in broken line, diagrammatically in FIG. 1 although they are, of course, at right angles to the position shown.

For certain metals it is advantageous to maintain a purge of nitrogen or inert gas in the atomizer dished end to limit oxidation of the formed powder. A supply tube 31 is shown for this purpose.

As described above energy from the nozzles 27 and 28 impinging on the water in the bath 13 induces a secondary circulation of water up the sloping walls 32 of the dished end and into the area of impact of the lower jets which produces immediate and rapid quenching of the atomized particles.

In order to further reduce oxidation and improve the rate of quench, it is desirable to add a small quantity of a commercial anti-foam both to the quench water and optionally to the atomizing water. As an example a concentration of 250 ccs of Duphar Midox Anti-foam to 700 gallons of quench water is satisfactory. This addition is the subject of a separate U.S. pat. application Ser. No. 789,915. Optionally a similar concentration of anti-foam can be added to the atomizing water. Optionally but not essentially a concentration of water soluble oil can be added as anti-oxidant to the quench water and atomizing water to reduce oxidation.

When atomizing certain metals it is found that there is a tendency for formation of explosive gas mixtures in the vessel. To inhibit the risk of explosion in such cases part or all of the volume of the dished hood is filled above the water level with a knitted wire mesh designed to slow a propogating flame front. The submerged but open end of the atomizing hood also serves to limit the pressure levels which can arise should explosive conditions occur.

There is a risk of failure of the refractory steel nozzle 23 during passage of molten metal. Although rare, the consequences of this can be explosive if the rate of flow of metal increases to a high level. To avoid molten metal reaching the bottom of the water bath and sticking to it, thus allowing trapped steam pockets to form with explosion risk, a wooden or plastic cone or sheet 33 is placed below the metal tundish nozzle on the base of the water bath.

Collection of the powder from the atomizer may be by slurry pump or by magnetic grab. In the former case, powder slurry is first pumped to a simple cyclone for primary separation and is subsequently dewatered by a filter system. Recovered water is first settled to remove as many fine particles as possible before passing through a fine filter (2–20 microns size) and returned to the high pressure pump feed water tank. In this manner harmful powder does not enter the seals of the high pressure pump.

I claim:

1. An atomizer for making powder comprising a vessel defining an atomizing chamber located above a water bath, the vessel having a lower part which widens out to be of inverted dished shape and a lower edge which extends into the water bath, means for establishing a falling stream of molten metal through the chamber towards the water bath, nozzle means arranged to supply first and second pairs of downwardly directed, long narrow sectioned primary jets of water, each at an angle to the vertical, the jets of each pair being symmetrically on opposite sides of the path of the metal stream, the nozzles of the pairs being on lines at right angles to one another, and arranged so that the jets of the first pair intersect at a level above the level of intersection of the jets from the second of the pairs, such that in use the jets from the first of the pairs impinge on the metal stream to form it into a ribbon shape substantially in a plane containing the second pair of nozzles and the jets from the second pair impinge on the ribbon to complete atomization into discrete particles of molten metal, the jets then impinging on the water bath and inducing a secondary circulation of quench water in the water bath, up the walls of said lower part and within said lower part of the atomizing chamber, the volume of the secondary circulation being greater than the volume of the primary jet flow and acting to quench the particles into powder.

2. An atomizer according to claim 1 in which the nozzles are angled so that the jets from the first pair make an angle between 16° and 35° to the vertical.

3. An atomizer according to claim 2 in which said angle is between 26° and 27°.

4. An atomizer according to claim 2 in which the nozzles are angled so that the jets from the second pair make an angle between 10° and 20° to the vertical.

5. An atomizer according to claim 4 in which the said angle is between 15½° and 16½°.

6. An atomizer according to claim 1 in which the first pair of nozzles are arranged so that their jets impinge on the stream not more than 12" below its point of establishment.

7. An atomizer according to claim 1 including quench water in the water bath at a height just below the level of intersection of the jets from the second pair.

8. An atomizer according to claim 1 in which the nozzles of both pairs are at substantially the same horizontal level.

9. An atomizer for making powder comprising a vessel having an axis and a lower edge, a water bath, the lower edge being immersed in the water bath so that the vessel defines a closed atomizing chamber above the water bath, means for establishing a falling stream of molten metal through the chamber towards the water bath, nozzle means arranged to supply downwardly directed primary jets of water under pressure at an angle to the vertical to impinge on the stream in an atomizing zone of the chamber and cause atomization of the metal into discrete particles, and then to impinge on said water bath, said vessel defining the atomizing chamber having a lower part comprising wall means which slope downwardly and outwardly such that the energy of the primary jet water impinging on the water bath induces a secondary circulation of quench water in the water bath, up said sloping wall means and into said atomizing zone of a greater volume than the primary jet flow so as to rapidly quench the atomized particles and form powder.

10. An atomizer according to claim 9 in which the atomizing chamber is defined by said vessel having a tubular upper part and a lower part which widens out and is of inverted dished shape to encourage water circulation, the lower end of said lower part having a diameter greater than twice the diameter of the tubular upper part.

11. An atomizer according to claim 9 in which the lower edge of the vessel defining the atomizing chamber is 2 to 6 inches below the water level in the water bath.

12. An atomizer according to claim 9 in which the sloping wall means makes an angle with the vertical which is greater than the angle it makes with the horizontal.

13. An atomizer according to claim 9 in which the nozzle means comprise first and second pairs of nozzles arranged to supply first and second pairs of downwardly directed, long narrow sectioned primary jets of water, the jets of the pairs being symmetrically on opposite sides of the path of the metal stream, the nozzles of the pairs being on lines at right angles to one another and arranged so that the first pair of jets intersect at a level above the level of intersection of the second pair of jets.

* * * * *